United States Patent [19]

Meinass et al.

[11] 4,341,234

[45] Jul. 27, 1982

[54] METHOD AND APPARATUS FOR EMPTYING VESSELS

[75] Inventors: Helmut Meinass, Wolfratshausen; Bernhard Volz, Munich, both of Fed. Rep. of Germany

[73] Assignee: Linde Aktiengesellschaft, Wiesbaden, Fed. Rep. of Germany

[21] Appl. No.: 194,898

[22] Filed: Oct. 7, 1980

[30] Foreign Application Priority Data

Oct. 8, 1979 [DE] Fed. Rep. of Germany ..... 2940755
Jun. 27, 1980 [DE] Fed. Rep. of Germany ..... 3024251

[51] Int. Cl.³ ..... F17D 1/02; G05D 7/01

[52] U.S. Cl. ..... 137/110; 137/113; 222/6

[58] Field of Search ..... 137/12, 14, 110, 113, 137/114, 599, 606, 607; 222/6; 62/50

[56] References Cited

U.S. PATENT DOCUMENTS 1,841,325 1/1932 Deming ..... 222/3
2,547,823 4/1951 Josephian ..... 137/113 X
2,968,162 1/1961 Acomb ..... 137/113 X
4,202,180 5/1980 Cox ..... 137/113 X

FOREIGN PATENT DOCUMENTS 525854 9/1940 United Kingdom ..... 137/113
1266163 3/1972 United Kingdom .

*Primary Examiner*—Robert G. Nilson
*Attorney, Agent, or Firm*—Karl F. Ross

[57] ABSTRACT

A method of and an apparatus for discharging containers of solubilized gas, e.g. acetylene, in which the gas is initially drawn as a preference stream from one container or group of containers (e.g. conventional acetylene bottles or tanks) and is fed to the consumer. When the pressure in the tank or tanks falls below a predetermined set point value, thereby indicating that the volume flow rate is less than the mean or average flow requirement, a second tank or group of tanks is connected to provide a complementary flow. The second tank or group of tanks supply the total requirement during replacement of the first tank or group and then forms the preference stream while the replacement tank or tanks of the first group provides the complementary stream.

4 Claims, 6 Drawing Figures

METHOD AND APPARATUS FOR EMPTYING VESSELS

FIELD OF THE INVENTION

Our present invention relates to an apparatus or system for the emptying of vessels. More particularly, the invention deals with the discharge of gases from vessels, i.e. so-called bottles, flasks or tanks, containing the gas under pressure and, specifically, in solution. In more specific terms, the invention relates to an apparatus for feeding a substantially constant supply of acetylene from conventional acetylene tanks, to a consumer device such as a torch or the like.

BACKGROUND OF THE INVENTION

While many industrial gases are supplied to the site at which they are to be used in the form of so-called steel bottles, flasks or tanks under pressure and even in liquefied form, other gases are stored, transported and delivered under pressure and solubilized in an appropriate solvent.

For use, gas is drawn from the tank by expansion and hence desolubilization, the reduction in pressure resulting in the evolution of the dissolved gas therefrom and its discharge from the tank.

The tank can be discharged through one or more parallel-connected pressure reducers until gas is no longer evolved by the solution. Generally this point is reached some time after the gas supply from the tank is insufficient to cover the average flow requirements of the consumer although the tank was able to supply enough gas to cover the average flow requirement for the greater portion of the discharge. In other words, during the terminal phase of gas evolution, the volume of gas discharged from the tank is generally less than the mean flow requirement.

The rate and degree to which gas is evolved and discharged from the tank is dependent upon the tank pressure and hence the degree to which gas is ultimately released from its solubilized state is a function of the final pressure at the vessel and the temperature within the interior thereof.

With conventional systems, in which gas supply from the container may be cut off prematurely because of the inability of the container to supply the mean flow requirement, otherwise available gas remains in the tank and is not utilized.

For example, in the case of acetylene flasks or bottles, the acetylene can only be completely utilized (i.e. withdrawn from solution until the latter is simply saturated at ambient pressure with the gas) if the amount of gas withdrawn per unit time is low, i.e. the flow rate is well below the ordinary flow demand and the expansion is effected against an extremely low pressure (back pressure).

If one or the other of these conditions is not met, the bottle is found to contain more acetylene than the saturation quantity, i.e. gas which is present in the bottle or in the solution in an amount above the saturation level.

There are many reasons for this. For example, an excessively rapid flow rate during the terminal phase may prevent the evaporation heat, the desolubilization heat or any heat of adsorption from being communicated to the solvent or from being uniformly distributed in the solvent. If the back pressure is excessive, the bottle interior may ultimately be under a superatmospheric pressure which enables considerable gas to be stored in the solvent beyond the ambient saturation quantity.

A further reason for unsatisfactory emptying of the tank can be the pressure loss in the pressure-reducing device with dropping forepressure, defined for the purpose of the present distribution as the pressure of the gas ahead of the pressure reducer, which increases sharply so that there is frequently an extremely large pressure differential between the forepressure and the backpressure. For a given backpressure, this means an exceptionally high forepressure and thus a high pressure within the tank.

OBJECTS OF THE INVENTION

It is the principal object of the present invention to provide an apparatus for the emptying of containers from gas stored therein under pressure, which increases the degree of emptying, i.e. the volume of gas which can be economically and conveniently recovered from the vessel.

Another object of this invention is to provide an apparatus feeding acetylene or a like gas solubilized under pressure in a solvent, to a consumer for the gas.

SUMMARY OF THE INVENTION

These objects and others which will become apparent hereinafter are attained in accordance with the invention in a method of discharging gas from a vessel, e.g. a bottle, flask or tank, in which the gas is stored under pressure and in solution in a solvent (e.g. acetylene dissolved in dimethylformamide) for feeding a consuming device (e.g. a torch arrangement) having an average or mean flow requirement (volumetric flow rate or volume per unit time) and the gas from the tank is fed to the consumer. According to the invention, as soon as the gas no longer is deliverable at a rate sufficient to meet the mean flow requirement, this gas stream from the partially emptied tank forms a "preference" gas stream which is mixed with a complementary gas stream drawn from a further tank and expanded to supply the deficiency in the volumetric flow rate necessary to meet the mean flow requirement.

The tank from which the preference stream is drawn, upon emptying, is replaced by a full tank and at least during the replacement of the empty tank by the full tank, the total gas demand is supplied by the second tank. After replacement of the empty tank by the full tank, the latter is connected to provide the complementary flow while the gas delivered by the second tank, formerly supplying the complementary stream, is transformed into the preference stream.

For the purpose of this description reference to a single tank, container or vessel, supplying the preference stream or the complementary stream, will be understood to include reference to a plurality or group of such vessels for both streams or either stream.

With the method of the present invention, a vessel or group of vessels connected in common to the discharge line, can be emptied to a greater degree than heretofore since, as the vessel or vessels empty, the flow contribution of the preference stream to the total volume rate of flow of the gas delivery, becomes progressively smaller and thus the withdrawal rate in the terminal phase of emptying is reduced to a level assuring maximum discharge of gas.

Thus, whereas with some earlier systems when the gas which could be delivered from a tank or group of tanks was no longer able to meet the average flow requirement the supply was cut off to enable a new tank or group of tanks to be connected to the gas delivery system, thereby leaving considerable gas in the tanks beyond the saturation level at ambient condition, the system of the present invention continues to draw gas preferentially from this tank or group of tanks long after the latter cannot meet the mean flow requirement.

Consequently, with the method of the present invention, usable gas normally considered a residue in the tank, can be utilized and the emptying of the tank can be more complete than with earlier systems.

The system of the invention utilizes a second tank or group of tanks (gas-supply means), filled with the same gas as the first tank or group, and provided with a respective pressure reducer which can deliver a complementary stream.

The expanded gas (preference stream) recovered from the predominantly empty tank is first combined with the gas drawn from the predominantly full tank (complementary stream) after the latter has been expanded to the backpressure. The quantity withdrawn from the full tank and mixed with the gas from the largely depleted tank corresponds, therefore, exactly to the deficiency which can no longer be supplied by the largely empty tank.

The system of the present invention allows each tank, therefore, to be emptied close to completeness i.e. to simple saturation gas remaining and which is a function of temperature. The empty container has a considerable pressure which is only slightly higher than the pressure established in the consumer-supply network. The consumer utilizes the contents of each container more effectively so that each container constitutes a larger gas reserve and fewer container's need be delivered to the use site, thereby reducing the transport costs as well.

According to a feature of the invention, the deficiency is automatically detected, i.e. the difference between the mean flow requirement and the gas available from the preference-stream tank, is automatically determined by measurement of flow rate or pressure. Thus means is provided for monitoring the emptying phase of each tank for controlling the connection of the complementary stream tank or for rendering the latter effective. With automatic means of this type for cutting in the complementary stream which automatically compensates for the deficiency, the torch operator or other personnel need not continuously monitor the states of the various tanks and particularly the operator need not be concerned with the terminal phase of a given tank.

When, according to the invention, the gas is expanded under automatically controlled conditions from the forepressure to the backpressure, the tank pressure is continuously monitored and by comparison of the monitored value with a setpoint value, the system is controlled to maintain the back pressure substantially and constant, i.e. substantially equal to the set-point value.

According to a further feature of the invention the pressure of the preference stream is controlled in response to a first setpoint value while the pressure of a complementary stream is controlled in response to a second setpoint value, the first setpoint representing a higher pressure level than the second setpoint.

In this process variant, as soon as the gas is no longer able to be delivered in an amount sufficient to cover the average gas requirement, the largely empty tank preferentially supplied gas. If the gas flow rate is sufficient, i.e. the tank pressure is above the first setpoint value, no gas will be withdrawn from the full tank. When the backpressure, i.e. the pressure with which the gas is fed into the supply network of the consumer, falls below a pressure corresponding to the first setpoint value, the pressure reducer, in which the gas from the largely empty tank is expanded, opens fully. As the backpressure drops further and falls below a pressure level corresponding to the second setpoint value, valves open to allow gas to be withdrawn from the full tank, expanding and mixed with the gas from partially empty tank to maintain a tank pressure corresponding to the pressure level of the second setpoint.

The total requirement (gas demand of the consumer) is covered by the sum of the partial streams with the flow rate from the partially empty tank (the preference stream) gradually reducing to zero and the stream from the full tank (complementary stream) gradually increasing to the full demand. The residual pressure in the tank from which no further gas is withdrawn can thus be significantly below the first setpoint value.

In the setting of the two setpoint values, it is important to select the spacing between the respective pressure level such that they are able to distinguish not only between the static pressures but also between the variable dynamic pressures of the two gas streams. This prevents detrimental hunting or improper operation of the control elements of the pressure reducers.

For a consumer apparatus using a continuous gas feed or a gas feed without sharp demand peaks, it has been found to be advantageous to mix the complementary stream with the preference stream below a tank pressure of the partly empty tank when the latter gas no longer can be delivered to supply the average requirement and/or at average pressure.

As long as the partly empty tank can cover the average demand requirement, the gas is exclusively drawn from the partially empty tank. When the demand can no longer be covered the further tank is connected and the partially empty tank is preferentially discharged while the further tank only supplied the deficiency.

If this system is to provide a continuous supply of the gas, a continuous monitoring of the backpressure is desirable. When the backpressure falls below a predetermined volume, the single source supply is switched over to double source supply, i.e. the supply is switched from the first tank or group of tanks as a single source to combine supply from these techniques and thus of the second group.

A prerequisite for a constant backpressure is thus the constant monitoring of the pressure in the tank from which the gas is instantaneously withdrawn. For this purpose we can use an automatic switch-over device thereby saving on personnel although the controls are very costly.

However in spite of automatic switch-over pressure drops cannot be fully excluded in the supply line and in operation significant fluctuations in the supply pressure to be controlled must be taken into consideration if the gas feed to the consumer device draws supply varying amounts rather than a substantially constant quantity of gas (per unit time).

In this case, an alternative mode of operation has been found to be advantageous in accordance with the invention. In this mode, the complementary stream is supplied at a pressure above the tank pressure of the partially emptied tank when the preference stream is no longer delivered in the average required quantity or at the average required pressure, and is mixed with the preference stream. In this variant the partially emptied tank is not discharged to a tank pressure below that at which the requisite gas demand can no longer be covered. Rather, this tank is discharged only at a switching pressure which lies between the pressure of the completely full tank and the pressure at which the gas (preference stream) can no longer satisfy the requisite demand or pressure.

At this switching pressure the gas supply can be switched over from the exclusive province of the partially emptied vessel to a supply from both vessels or groups thereof. The preference stream thus derives from this first vessel or group of vessels while the comlementary stream which completes the demand is supplied by the other vessels.

With this variant of the method of the present invention, numerous advantages accrue. Since the switch-over of gas supply to both groups of vessel (double source) is not effected at a defined tank pressure but can be accomplished over a wide pressure range, the need for expensive automatic switching devices is eliminated. Basically the switch-over can take place at any time, i.e. at any pressure level within the above mentioned pressure range. An especially effective switch-over point is, however, the point at which the tank from which the preference stream is withdrawn is at its terminal pressure and this tank can be replaced by a full tank. During the replacement, the gas is supplied exclusively from the second tank or group of tanks which theretofore provide only the complementary stream.

The empty tank of the first can be cut off and replaced by a full tank. According to an important feature of the invention, immediately after replacement of an empty tank by the full tank, the two groups of tanks or vessels are switched so that the tank of the second group, which is now partially empty, serves to supply the preference stream while the newly installed tank delivers the complementary stream.

This simplifies service of the facility and reduces labor cost inasmuch as personnel need be present only for tank replacement and need not be in attendance during intervals between tank replacements.

The system of the present invention facilitates continuous gas supply and sharp pressure drops in the supply lines of the tank as have been encountered heretofore are compensated.

If a sudden increase in the gas demand cannot be covered by one of the groups of tanks, the other group is available to deliver the deficiency and hence even with sharp and sudden increases in demand a substantially uniform supply is assured.

Naturally one of the groups must always be capable of delivering the complementary stream while the main or preferred stream is delivered by the other group. By comparison with earlier processes using simple switch-over from tank to tank or using only a single tank, fluctuations in the supply pressure to be controlled can be markedly reduced.

Another advantage of the method of the present invention is the reliability of the apparatus for carrying it out. With high gas extraction velocities, solvent vapors and even liquid particles of the solvent can be entrained with the gas. When the solvent is dimethylformamide which reacts readily with elastomers, the solvent can damage seals, membranes and like elements. This danger is especially pronounced when the gases are to be withdrawn from full bottles or bottles which have been filled only shortly before withdrawal.

With the process of the present invention full tanks provide the complementary stream with the basic demand being delivered by the preference stream. The complementary stream thus only serves to compensate for demand peaks and, per unit time, only small quantities of the gas are withdrawn from the full tanks. This gas is generally withdrawn at a relatively low velocity so that the entrainment of solvent in liquid form is largely avoided.

When, of course, the device is switched over so that the tanks formerly supplying the complementary stream then delivers the preference stream, the tank is no longer completely full, again avoiding entrainment or discharge of the liquid solvent.

It has been found to be advantageous when acetylene is withdrawn from conventional bottles (tanks) to utilize the second or further vessel or tank initially as the source of the complementary stream and after replacement of the empty tank by a full tank as the source of the preference stream.

In this case the second or further tank is emptied until its tank pressure has dropped to a volume $x^k$. The volume $x^k$, upon integration of the gas volume of the complementary stream over the corresponding withdrawal type, is not less than 3 bar, preferably not less than 10 bar. This integration is represented as $$\int V^k dt = \int_{P_b}^{x^k} V^k \left( \frac{\delta P_v{}^k}{\delta^t} \right)^{-1} dp_v$$

In this relationship:

$V^k$ is the volumetric flow of the complementary stream, $P_b$ is the pressure of the full tank, $x^k$ is the pressure until which the tank supplies the complementary stream, $p_v{}^k$ is the forepressure of the complementary stream.

This dimensioning ensures that there will be sufficient time for further emptying of the tank as the supplier of the preference stream and also ensures a sufficient gas reserve for the period in which the bottle is the sole supplier of gas, e.g. during the replacement of an empty tank of the other group by a full tank.

As soon as the replacement of the empty tank has been completed, the full tank is treated as the source of the complementary stream and the system is switched over so that the tank formerly acting as the supplier of the complementary stream will deliver the preference stream.

According to a feature of the invention, moreover, it is advantageous to draw gas as the preference stream from a tank as soon as the tank pressure has reach a predetermined value.

This pressure should be at least 1.5 bar, preferably more than 10 bar and defines the upper level of the integration of the preference stream over the corresponding gas withdrawal time.

This integration is given below:

$$\int V^p dt = \int_{x^p}^{y} V^p \left( \frac{\delta P_v^P}{\delta^t} \right)^{-1} dp_v$$

Gas is recovered as the preference stream until the tank pressure has dropped to a level y less than 3 bar and preferably y less than 1.5 bar. This ensures emptying of the tank to a very limited residual quantity of gas above saturation without detrimentally affecting the ability of the tank to deliver the gas.

According to another feature of the invention, the attainment of the terminal pressure y and thus the point at which the empty tank must be replaced by a full tank, is signalled optically or acoustically.

According to another aspect of the invention, a device for carrying out the method of the invention comprises respective lines communicating with each of the vessels or tanks, or groups of vessels or tanks, for the preference stream and the complementary stream, respectively, each of these lines being provided with a cut-off valve and an automatic pressure regulator, the two lines from the regulator merging to form the supply line to the apparatus at which the gas is to be fed.

In more general terms a preference-stream conduit can be provided between a first tank or group of tanks (first gas storage means) and the gas-consumer means, this line being provided in succession with a cut-off valve and a pressure-reducing valve or pressure controller. A second gas supply means (tank or group of tanks) has a line opening into the first mentioned line and adapted to deliver the complementary stream thereto. In this embodiment, it is necessary after emptying one of the tanks or group of tanks to reset the setpoint value.

In a preferred or best mode embodiment of the invention, therefore, we provide each gas supply means with a respective line, each provided in succession with a cut-off valve and a pressure controller, each line being formed with a switch-over valve between the cut-off valve and the respective controller and a cross-over conduit which is tapped from each line between its cut-off valve and switch-over valve and the pressure reducer of the latter, each of these cross-over conduits being formed with a switch-over valve and all of the switch-over valves being ganged for joint operation.

This arrangement allows continuous feeding of gas to the consuming machine and therefore continuous withdrawal of gas or from one or both of the gas-supply means and eliminates the need for adjustment of the setpoint values for the pressure controllers since the gas from the partially emptied tank by appropriate setting of the switch-over valves is fed through the respective connecting conduit into the line in which the pressure of the expanded gas is controlled in accordance with the first setpoint value.

Subsequently at the point at which the tank is practically completely empty, the associated shut-off valve can be closed to allow replacement of the tank by a full tank until the gas continues to be fed from the tank of the other line.

Functional reversal from preference stream to compensating stream and vice versa can be effected by operating all reversing valves by a common switch-over device.

According to another feature of the invention the switch-over device comprises a volumetric, hydraulic or electric servo motor. The servo motor can be operated by compressed air, for example, in dependence upon the forepressure of the recovery lines. The gas of the supply means may be, of course, also be used to drive the servo motor.

Advantageously, the pressure controllers or the preference stream in the complementary stream have respective well defined characteristic curves, i.e. predetermined relationships between forepressure and backpressure correlations with the volume rate of flow, the streams being expanded in the pressure controller.

Basically the preference stream and complementary stream can be expanded in all pressure controllers having characteristic curves in the forepressure and backpressure diagrams which lie closely together. In this case the difference of the setpoint values in response to which the backpressue of the pressure controllers are regulated, are determined by the tolerable variation of the backpressure, i.e. the pressure in a supply line running to the gas-consumer means.

Best results combine two pressure controllers whereby the preference stream is expanded in a controller with a horizontal or increasing characteristic curve while the complementary stream is expanded in a controller with a horizontal or flowing curve the volumetric flow rate in each case being constant. This means that with dropping pressure in the bottle or the tank, the pressure of the preference stream after expansion in a wide pressure range remains constant or increases, while the pressure of the complementary stream from expansion with decreasing bottle pressure remains constant over a wide range or force.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
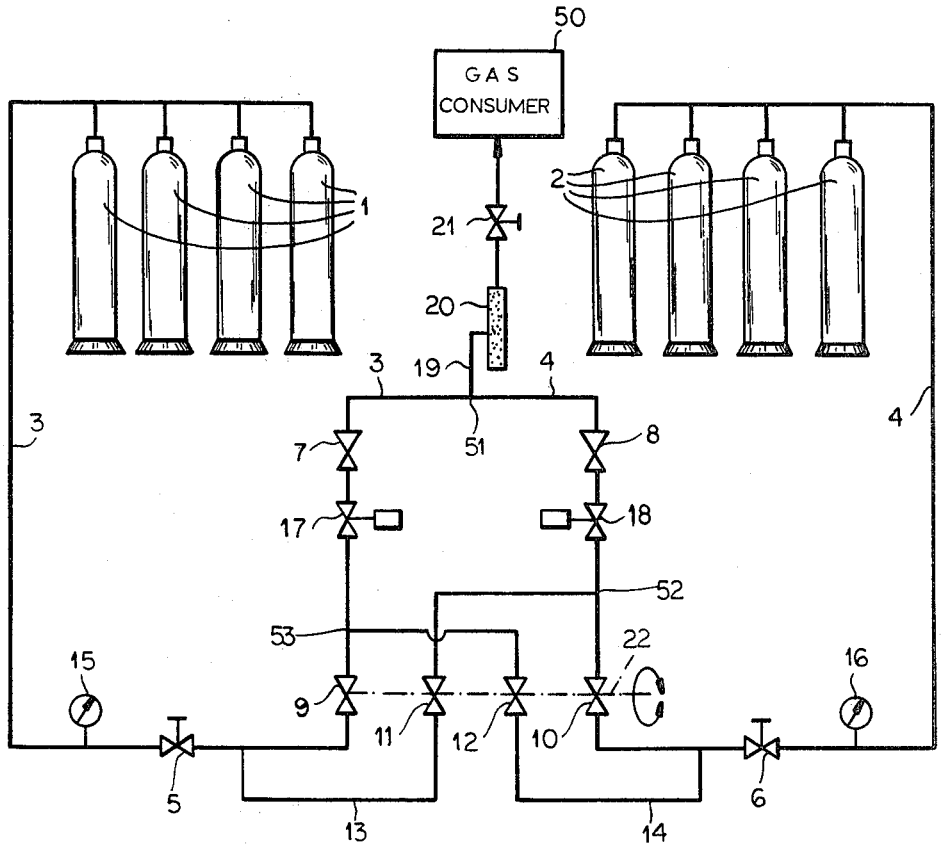
FIG. 1 is a flow diagram of a device in accordance with the present invention.

In FIG. 1 of the drawing we have shown a device for supplying a gas consumer which has been represented generally at 50 with bottled gas which is solubilized in an appropriate solvent, e.g. acetylene dissolved in acetylene fluid. The system comprises a first group of bottles or tanks 1 and a second group of bottles or tanks 2 each of which is provided with a respective discharge line 3 or 4 through which gas is withdrawn from the tanks.

The gas withdrawal line 3, for example, is provided with a pressure-measuring device such as a gauge 15, a shut-off valve 5, a switch-over valve 9, an automatic speed-closure valve 17 and an automatic pressure controller 7 in which the gas is expanded, all in series.

Similarly line 4 is provided with a pressure measuring device 16, a shut-off valve 6, a switch-over valve 10, a quick closure valve 18 which is automatically operable and the pressure controller 8 all in succession.

Lines 3 and 4 join at 51 and feed the gas mixture into a supply line 19 for the gas consumer 50. Between the gas consumer 50 and the mixing junction 51, the line 19 is provided in succession with a flame barrier 20 to prevent backfiring and a further cut-off valve 21.

The two withdrawal lines 3, 4 are provided with respective cross over or interconnecting ducts 13 or 14. The duct 13 opens into line 3 between the cut-off valve 5 and the switch over valve 9 and is provided with its own switch over valve 11.

Complementarily line 14 communicates with line 4 between the cut-off valve 6 and the switch-over valve 10 while having its own switch-over valve 12. Line 13 opens into line 4 at a junction 52 between the switch-over valve 10 and the pressure regulator 8 and preferably between the switch-over valve 10 and the quick closure valve 18.

The line 14 opens into line 3 at a junction 53 between the switch-over valve 9 and the quick closure valve 17. The quick closure valves 17 and 18 prevent uncontrolled release of gas.

Figure 1A:
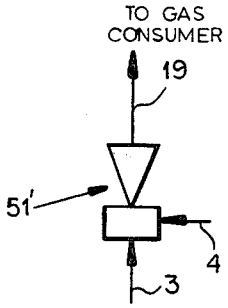
FIG. 1A is a diagram of a modified connection between gas withdrawal lines for use in the system of FIG. 1.

At the junction 51, as represented at 51' in FIG. 1A, an injector of the venturi type can be connected as illustrated to combine the complementary and preference gas streams.

In a mode of operation in which the complementary gas stream is mixed with the preference gas stream at a pressure below the tank pressure of the partially emptied tanks when gas cannot be supplied by the latter in the average required volume and/or at the average required pressure, the filled tanks 1 are fully emptied, valve 5 is then opened and the common activator for the ganged switch-over valves 9, 10, 11, 12 is rotated so that walls 11 and 12 are opened while the valves 9 and 10 are closed. The valve 6 is likewise closed. Acetylene flows through the withdrawal line 3, the connecting duct 13 and the pressure controller 8 to the gas chamber 50.

Acetylene is drawn from the tanks 1 in this manner in a sufficient volume and at sufficient pressure to satisfy the gas consumer.

As soon as the pressure in the withdrawal line 3 falls below a predetermined value, for example 2 to 3 bar, at which the acetylene from the tanks 1 is no longer available in sufficient quantity and/or at sufficient pressure, the switch-over device 22 is operated e.g. manually to open the valves 9 and 10 and close the valves 11 and 12.

Simultaneously, the valve 6 is opened. Acetylene continues to flow from the tanks 1 through line 3 and valve 9 through the pressure controller 7, rather than in its first while pass through duct 13. In addition acetylene for the filled tank 2 passes via line 4, the valve 6, valve 10 and the pressure controller 8 to the consumer 50.

To this end the controller 8 must be opened and serves to allow expansion of the gas from the high bottle pressure (forepressure) to a constant lower pressure (backpressure). This pressure controller, however, opens only when the backpressure drives below a predetermined control pressure which is set. In the embodiment illustrated this value is 0.7 bar.

Controller 8 opens as well and the complementary stream is delivered to make up the deficiency which can no longer be supplied by the tanks 1.

The acetylene thus flows preferentially from tanks 1 to the consumer.

When the pressure in tanks 1, as read from the manometer 15, falls below the predetermined value for example of 0.9 bar, valve 5 is closed and the empty tanks 1 are replaced by full tanks. During this period the gas consumer 50 is supplied exclusively with the acetylene from the tanks 2. When the pressure in tanks 2 drops below a value of about 2 to 3 bar, the switch-over device 22 operates the valves 9 and 12 anew to unblock valves 11 and 12 but block valves 9 and 10. Valve 5 is likewise opened. This means that acetylene is supplied from the narrow partially empty tanks 2 via a pressure control 7 to the gas consumer 50 while the new filled tanks 1 merely deliver the complementary stream to make up the deficiency.

To cover brief but high gas demands, the tanks of both groups, for example, in the case of acetylene can be filled to a pressure of 15 bar. Initially, the tanks of group 1 are emptied and valves 5, 11 and 12 are opened while valves 6, 9 and 10 are closed.

The acetylene flows from tank 1 via line 3, valve 5, line 13, valve 11 and line 4 with its quick-closure valve 18 and pressure controller 8 to the supply line 19.

From the beginning of the gas withdrawal from the tanks 1 and as late as the point at which the pressure in tanks 1 has dropped to a value of $x^k$ greater than 1.5 bar (for example about 5 bar), the switch-over device 22 can open the valves 9 and 10 and simultaneously close the valves 11 and 12. If, then, the cut-off valve 6 is opened, gas from the tanks 1 flows via valve 9, the quick closure valve 17 and the pressure controller 7 to the supply line 19.

When consumption peaks are generated frequently and cannot be fully satisfied by the gas from the first group of tanks, additional gas can be supplied by tanks 2 through the pressure controller 8 for mixture with the gas from line 3. The pressure controller 8 has a setpoint value which lies below that of the pressure controller 7.

In the embodiment the setpoint value of controller 8 corresponds to a pressure level of 0.8 bar so that this valve opens fully only when the bar pressure drops below 0.7 bar. At the beginning of the emptying of tanks 1 the tanks 2 contribute only very briefly squirts of gas in low volume to correspond to the deficiency represented by the peak. Only with progressive emptying of the tanks 1 is the gas drain from tanks 2 increased to cover increasing deficiencies. Because of the preference switching, i.e. the difference in the setpoint values of the 2 pressure reducers 7 and 8, the gas is preferentially drawn from tanks 1 (preference stream) and gases only withdrawn from tank 2 (complementary stream) when necessary to make up the deficiency.

When the pressure of tanks 1 reaches a predetermined final pressure y of about 0.85 bar, the switch-over device 22 is operated again and the valves 9 through 12 rotate about the common axis to close valves 9 and 10 and open valves 11 and 12. By means of the cut-off valve 5 the tanks 1 are shut off from the remainder of the system and replaced by full tanks. In the period between switch over and at least during tank replacement the gas requirement of the consumer 50 is covered completely by tanks of the second group. The gas thus flows from the tanks 2 via line 4, cut-off valve 6, duct 14, valve 12, quick closure valve 17 and pressure controller 7 to the supply line 19.

Advantageously directly following connection of a new full tank to line 3, the cut-off valve 5 is opened and thus the gas from tanks 2 constitutes the preference stream while the complementary stream is delivered by the newly connected valves.

Figure 2:
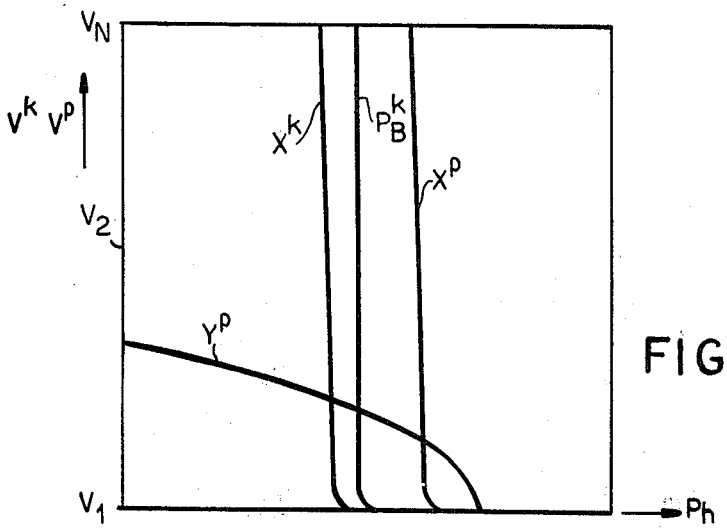
FIG. 2 is a characteristic diagram in which the gas quantity withdrawn as a formation of time is plotted against the respective backpressure.
Figure 3:
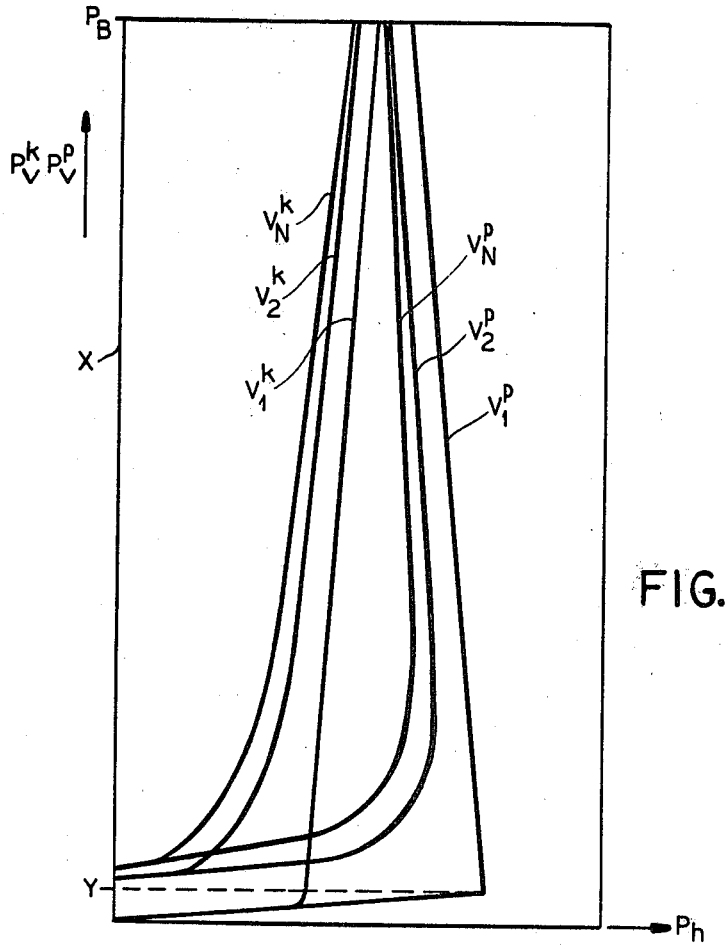
FIG. 3 is a diagram in which, with constant volumetric flow, the forepressure is plotted against the backpressure.

FIGS. 2 and 3 show the characteristic curve of the pressure controllers 7 and 8. In both figures and in FIG. 4, the backpressure $p_h$ is plotted along the abcissa. In FIG. 2, the volume rates of flow (volume per unit time) from the tanks of the complementary stream $V^k$ and of the preference stream $V^p$ have been plotted.

The lines shown are lines of constant forepressure, i.e. $p_v$ equals a constant.

In these curves, $V_n$ is the volume flow rate at nominal maximum drain, $V_2$ is the volume flow rate at about half the nominal value and $V_1$ represents a static state at which there is zero valume flow rate.

As will be apparent from the foregoing, the subscripts or superscripts k and p respectively refer to the complementary stream and the preference stream.

As will be apparent from FIG. 2, the invention preferably operates with pressure controllers with sharp or steep characteristic curves, i.e. the backpressure with constant forepressure and decreasing flow rate V remains practically constant.

In FIG. 3, the forepressures are plotted against the ordinate. The characteristic curves are lines of constant flow rate V. The same scales are used in FIGS. 2 and 3 at least as to the backpressure. The three characteristic curves on the right hand side of FIG. 3, represented at $V_n$, $V_2$ and $V_1$ are three characteristic curves of the pressure controller 7 through which the preference stream flows while the three lines to the left, i.e. to the lower backpressure side (corresponding to a lower setpoint value) are corresponding characteristic curves for the pressure controller 8. Advantageously the pressure controller for the preference stream has a characteristic curve such that the backpressure over a wide pressure range with decreasing forepressure increases while the corresponding curve drops for the pressure controller of the complementary stream.

Figure 4:
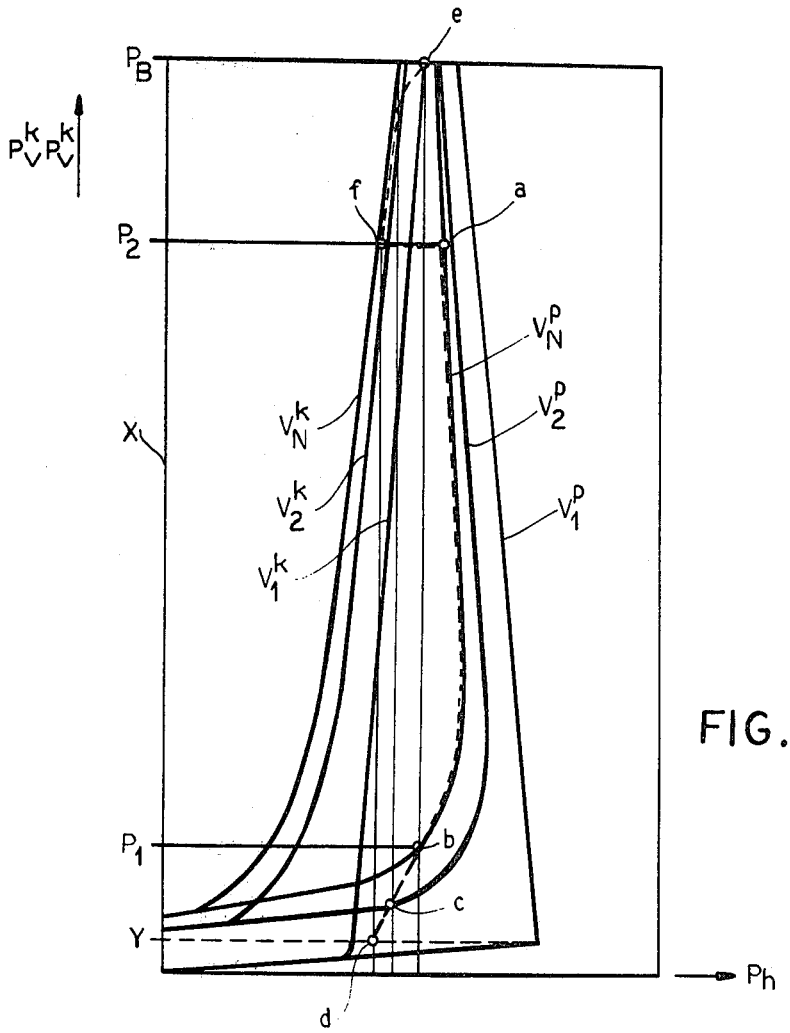
FIG. 4 is a diagram similar to FIG. 3 showing the characteristics at a different point in the operation.

FIG. 4 is a diagram similar to FIG. 3 which represents a typical example for ideal gas withdrawal. According to the embodiment of the invention described above, the term "ideal" is used to signify that pressure variations are not considered.

The preference stream is resumed to be drawn from the group of tanks 1 while the complementary stream is withdrawn from the group of tanks 2.

The pressure in tank 1 should not be greater than the tank pressure, i.e. the forepressure $p_v$ less than the tank pressure $p_b$. The gas should be withdrawn in an amount corresponding to the nominal rate $V_m$. These starting conditions correspond to point a in FIG. 4.

During gas withdrawal, the tank pressure and thus the forepressure drop according to the characteristic line $V_n$. Because of the nature of the characteristic curve, the backpressure $p_h$ initially increases and then after a flat maximum, drops.

The point b at backpressure $p_h$ has fallen to the value $p_1$ which corresponds to the setpoint of the pressure controller 8 for the complementary stream.

From this point on, the preference stream is supplemented by gas from tanks 2, i.e. by the complementary stream.

The volumetric flow of the preference stream continues to drop and the flow falls from a value $V_n$ greater than $V_2$ to a value of practically $V_1$ (points c and d).

The tanks of the first group are thus discharged to a final pressure y. During the same time the volumetric flow per unit time of the complementary stream increases from $V_1$ (point e) through $V_2$ to $V_n$ at point f.

At this point, the valves 9 through 12 are reversed and the tanks of the first group are replaced by full tanks after valve 5 has been closed.

From tank replacement on, the gas flows from the tanks 2 via the pressure controller 7.

Corresponding to the pressure $V_2$ at point f, the backpressure $V_f$ is transformed on tank replacement to $V_a$ and the process is repeated as tanks 2, now providing the preference stream, are emptied.

The difference between practical and ideal situations is that the backpressure in the practical case usually fluctuates in accordance with the gas demands. As long as these fluctuations are not greater than the difference in the setpoint values, the gas demand is satisfied fully by the preference stream until the complementary stream is drawn upon. However, should the brief backpressure drop during high gas demand below the setpoint value of the pressure controller for the complementary stream, the gas is withdrawn from the complementary tank and mixed with the preference stream when the preference tanks are full.

Figure 5:
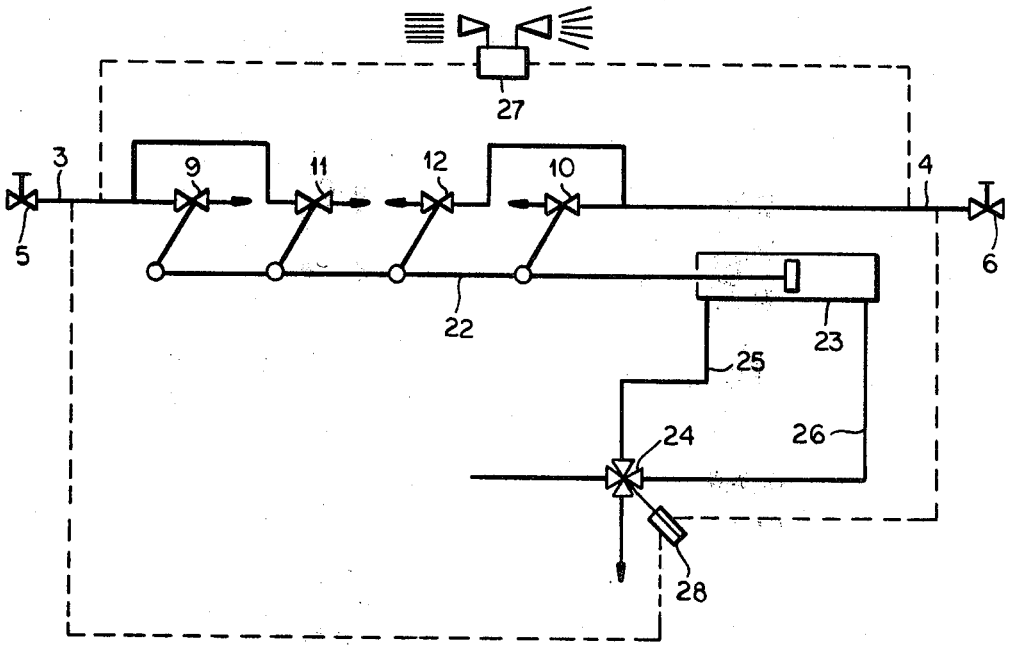
FIG. 5 is a flow diagram of an automatic control arrangement.

In FIG. 5 we have shown a pneumatically actuated switch-over device for automatically reversing the valves 9 through 12. This switch-over device comprises a servo-motor of the pneumatic type controling a two-position, four-way valve 24. When the pressure in a withdrawal line or the most empty tanks falls below a predetermined pressure, for example 2 to 3 bars, the valve 24 is actuated by the servo-motor 28 and via lines 25 and 26 pressurizes the servo-follower cylinder 23 in the corresponding direction to reverse the position of the switching device 22.

When the pressure falls sufficiently to require replacement of the empty tank an acoustic or optical warning device 27 is triggered.

We claim:

1. A gas supply apparatus comprising first and second acetylene-delivering gas supply means for expanding acetylene gas and supplying same to an acetylene-gas consumer, each of said gas supply means including a respective group of tanks containing said gas under pressure, each group of tanks being provided with a respective withdrawal line, each of said withdrawal lines being provided in succession with a cut-off valve, a switch-over valve and an automatic pressure controller before said lines join to feed said consumer, a respective connecting duct communicating with each line between the cut-off valve and switch-over valve thereof and opening into the other of said lines between the switch-over valve and the pressure controller thereof, each of said ducts being provided with a respective switch-over valve, and control means including said controllers for initially drawing gas from said first gas supply means and upon partial emptying of said first gas supply means continuing to withdraw gas therefrom and to feed said consumer therewith in a preference stream, and for mixing said preference stream with gas drawn from said second gas supply means with progressive increase in the rate of flow of gas from said second gas supply means upon decrease in the rate of flow from said first gas supply means, the gas from said second gas supply means forming a complementary gas stream, said control means responding to comparison of the pressures of said preference and complementary streams with first and second set point values, each first set point value corresponding to a higher pressure level than the respective second set point value, the pressure controller of the line through which the preference stream is drawn having a horizontal or increasing characteristic curve while the pressure controller of the line through which said complementary stream is drawn having a horizontal or decreasing characteristic curve so that at a constant volumetric flow rate with a decreasing tank pressure, the pressure of the respective gas after expansion remains constant or increases over a broad pressure range for the preference stream and remains constant or decreases over a broad pressure range from the complementary stream.

2. The apparatus defined in claim 1, further comprising a common actuator connected to all of said switchover valves.

3. The apparatus defined in claim 2, further comprising a pressure-controlled servomotor connected to said actuator for automatically operating same.

4. The apparatus defined in claim 1, further comprising an injector connected between said lines.

* * * * *